US007490735B2

(12) United States Patent
Raines et al.

(10) Patent No.: US 7,490,735 B2
(45) Date of Patent: Feb. 17, 2009

(54) METHOD AND APPARATUS FOR DISPENSING A HOT-MELT ADHESIVE

(75) Inventors: Kevin M. Raines, Akron, OH (US); Hank W. Gonzalez, Canton, OH (US); George E. Blumb, Noblesville, IN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 11/866,058

(22) Filed: Oct. 2, 2007

(65) Prior Publication Data

US 2008/0023485 A1 Jan. 31, 2008

Related U.S. Application Data

(62) Division of application No. 10/865,023, filed on Jun. 10, 2004, now Pat. No. 7,296,707.

(51) Int. Cl.
*B67D 5/08* (2006.01)
*B67D 5/14* (2006.01)
*F27B 14/00* (2006.01)

(52) U.S. Cl. ..... 222/54; 222/146.5; 222/262; 222/387; 222/389; 219/422; 219/424; 219/425

(58) Field of Classification Search ..... 222/146.5, 222/146.2, 146.1, 146.6, 54, 504, 263, 61, 222/325, 262, 326, 327, 386, 387, 389, 380, 222/434, 256, 362.326; 219/424, 422, 425, 219/426, 421; 118/323, 669, 679, 302, 410; 318/568.1, 568.11, 574, 567; 901/16; 427/207.1, 427/208.2

See application file for complete search history.

(56) References Cited

U.S. PATENT DOCUMENTS

| | | | | |
|---|---|---|---|---|
| 2,475,395 | A * | 7/1949 | Lester | 425/144 |
| 4,033,484 | A | 7/1977 | Ornsteen | |
| 4,320,858 | A * | 3/1982 | Mercer et al. | 222/146.5 |
| 4,678,100 | A * | 7/1987 | Gelinas et al. | 222/52 |
| 4,711,379 | A | 12/1987 | Price | |
| 4,988,015 | A * | 1/1991 | Price | 222/1 |
| 5,027,976 | A | 7/1991 | Scholl et al. | |
| 5,350,084 | A | 9/1994 | Miller et al. | |
| 5,375,738 | A | 12/1994 | Walsh et al. | |
| 5,458,275 | A | 10/1995 | Centea et al. | |

(Continued)

OTHER PUBLICATIONS

3M Adhesives Division, Jet-Weld Thermoset Adhesive System catalog, Copyright 2000, 8 pages.

(Continued)

*Primary Examiner*—Kevin P Shaver
*Assistant Examiner*—Stephanie E. Tyler
(74) *Attorney, Agent, or Firm*—Sand & Sebolt

(57) ABSTRACT

An apparatus and method for dispensing controlled precise amounts of a hot-melt adhesive. A positive displacement dispenser which is mounted on a programmable motion system is connected to a hot-melt cartridge feed assembly by an inlet block. The dispenser, feed assembly, and inlet block contain electric heaters and thermocouples for maintaining the adhesive at a desired elevated temperature. A computer control system regulates the temperature in the dispenser, feed assembly, and inlet block and controls a dispensing motor in the dispenser. A preheater heats an adhesive cartridge prior to placement in the feed assembly.

16 Claims, 5 Drawing Sheets

U.S. PATENT DOCUMENTS 5,535,919 A 7/1996 Ganzer et al.
5,747,102 A 5/1998 Smith et al.
5,875,922 A 3/1999 Chastine et al.
5,927,560 A 7/1999 Lewis et al.
5,979,794 A * 11/1999 DeFillipi et al. ..... 239/135
6,085,943 A 7/2000 Cavallaro et al.
6,520,382 B2 2/2003 Estelle et al.
6,669,057 B2 12/2003 Saidman et al.
6,736,900 B2 5/2004 Isogai et al.
7,156,261 B2 1/2007 Saidman et al.
7,211,162 B2 * 5/2007 Okuda et al. ..... 156/78
2002/0142102 A1 * 10/2002 Romine ..... 427/421

OTHER PUBLICATIONS

Liquid Control Corp., Dispensit Model 1052 Rod Positive Displacement Dispense Valve brochure, Copyright 2001, 2 pages.

* cited by examiner

METHOD AND APPARATUS FOR DISPENSING A HOT-MELT ADHESIVE

CROSS REFERENCE TO RELATED APPLICATION

This application is a divisional of U.S. patent application Ser. No. 10/865,023, filed Jun. 10, 2004; the disclosure of which is incorporated herein by reference.

BACKGROUND OF THE INVENTION

1. Technical Field

The invention relates to dispensing precise quantities of a hot-melt adhesive in exact locations on an object. In particular, the invention relates to a compact unit including an adhesive feed assembly and a positive displacement dispenser mounted closely together by an inlet block, which unit is mounted on a two or three-dimensional motion system and is connected to a control unit which maintains the temperature of the adhesive at critical levels as it moves through the unit and dispensed onto the object.

2. Background Information

The dispensing of extremely small amounts or shots of flowable materials at a precise location in a rapid and controlled manner presents a challenge to those in the dispensing art due to the viscosity of the materials and the extremely small amounts that must be precisely delivered at a precise location on an object. This is especially critical where the adhesive is a hot-melt moisture cured adhesive which is extremely temperature sensitive, and once heated, remains in a stable state for only a certain duration of time, thereby requiring it to be maintained at a certain temperature and dispensed within that time period to prevent the adhesive curing within the dispensing equipment, requiring expensive and time consuming cleaning of the dispensing equipment and disposal of the remaining adhesive, which increase the manufacturing costs of the objects onto which the adhesive is being dispensed.

Various types of positive displacement dispensers, such as shown in U.S. Pat. Nos. 5,350,084 and 5,458,275, provide for positive displacement of adhesives. However, the adhesives used in these types of machines are not always temperature critical nor are they supplied in cartridges, and thus are not concerned with the problem of maintaining a critical temperature of the adhesive being dispensed from the supply adhesive in a replaceable cartridge through the dispenser.

Other devices, such as distributed by Minnesota Mining and Manufacturing Company under their Trademark JET WELD provide a dispenser which maintains an adhesive contained within a cartridge at a certain temperature to prevent premature curing thereof. However, these dispensing systems do not accurately control and dispense extremely precise amounts of the adhesive as does a positive displacement dispenser, as discussed above.

Furthermore, it is desirable for many repetitive tasks to mount the dispenser and adhesive supply on a motion control system for repetitive uniform motion of the dispenser for accurately and repeatedly dispensing the adhesive on the objects as they move into position adjacent the control system, while maintaining the constant uninterrupted flow of the adhesive, wherein the temperature is maintained at precise levels throughout the system, and which enables the assembly line-type production to be continuously maintained with very little down time.

These problems are difficult to overcome with the available mechanisms currently in use today for dispensing certain types of temperature sensitive adhesives, and in particular a hot-melt adhesive which is moisture cured relatively quickly after being exposed to the atmosphere, and when used with an adhesive having a relatively short life once heated to a desired temperature.

Therefore, the need exists for a system, method, and apparatus for accurately dispensing small amounts of a hot-melt adhesive which cures within a limited time period after being heated and exposed to the atmosphere, in a compact, highly efficient and reliable apparatus and method of dispensing.

BRIEF SUMMARY OF THE INVENTION

One aspect of the present invention is to provide a compact unit for containing a supply of a heated adhesive, such as a hot-melt moisture cured adhesive, which is fed to a positive displacement dispenser through an inlet block, both of which are provided with heaters for maintaining the adhesive at desired levels.

Another aspect of the invention is to supply the cartridges containing the adhesive in a preheated state prior to inserting the cartridge into an adhesive feed assembly, thereby maintaining a constant supply of heated adhesive to the dispenser, reducing down time of the unit and interruption of the manufacturing process.

A still further feature of the invention is to insulate the adhesive feed assembly housing, inlet block and positive displacement dispenser to reduce the escape of heat therefrom so that the heat which is applied to the adhesive maintains the adhesive at its critical temperature throughout the unit from the supply cartridge until it exits a dispensing needle onto an object.

Another feature of the invention is to provide a quick disconnect which enables the spent adhesive cartridge to be replaced quickly and easily with a preheated filled cartridge, with the adhesive being at a desired temperature.

Another aspect of the invention is to provide a control unit connected to the various components of the system to provide precise control thereof.

A further feature of the invention is to mount the compact unit on a two or three-dimensional motion control system which will repeatedly and accurately move the unit, and in particular the dispensing needle thereof, over an object whereupon the heated adhesive is dispensed at a precise location and in the correct amount on the object receiving the adhesive.

These features and advantages are achieved by the apparatus of the present invention which comprises a positive displacement dispenser for dispensing precise quantities of the hot-melt adhesive on an object, a feed assembly adapted to contain a cartridge of the adhesive to be dispensed by the dispenser, the feed assembly including a heater for heating the adhesive, an inlet block for mounting the feed assembly on the dispenser, the inlet block including a fluid passage for conveying the adhesive from the feed assembly into the dispenser and a heater for heating the adhesive as it is conveyed through said passage, and a control unit operatively connected to the dispenser, feed assembly and inlet block for maintaining the adhesive at a predetermined temperature in the feed assembly and inlet block, and for moving the adhesive from the feed assembly through the inlet block for subsequent dispensing from the dispenser.

These features and advantages are further achieved by the improved method of the present invention, the general nature of which may include the steps of preheating a cartridge containing the adhesive to a first temperature, placing the preheated cartridge into a feed assembly, heating the adhesive to a second temperature in the feed assembly, moving the adhesive from the cartridge through an inlet block and into a positive displacement dispenser, heating the adhesive moving through the inlet block to a third level, and dispensing the heated adhesive from the dispenser onto an object.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
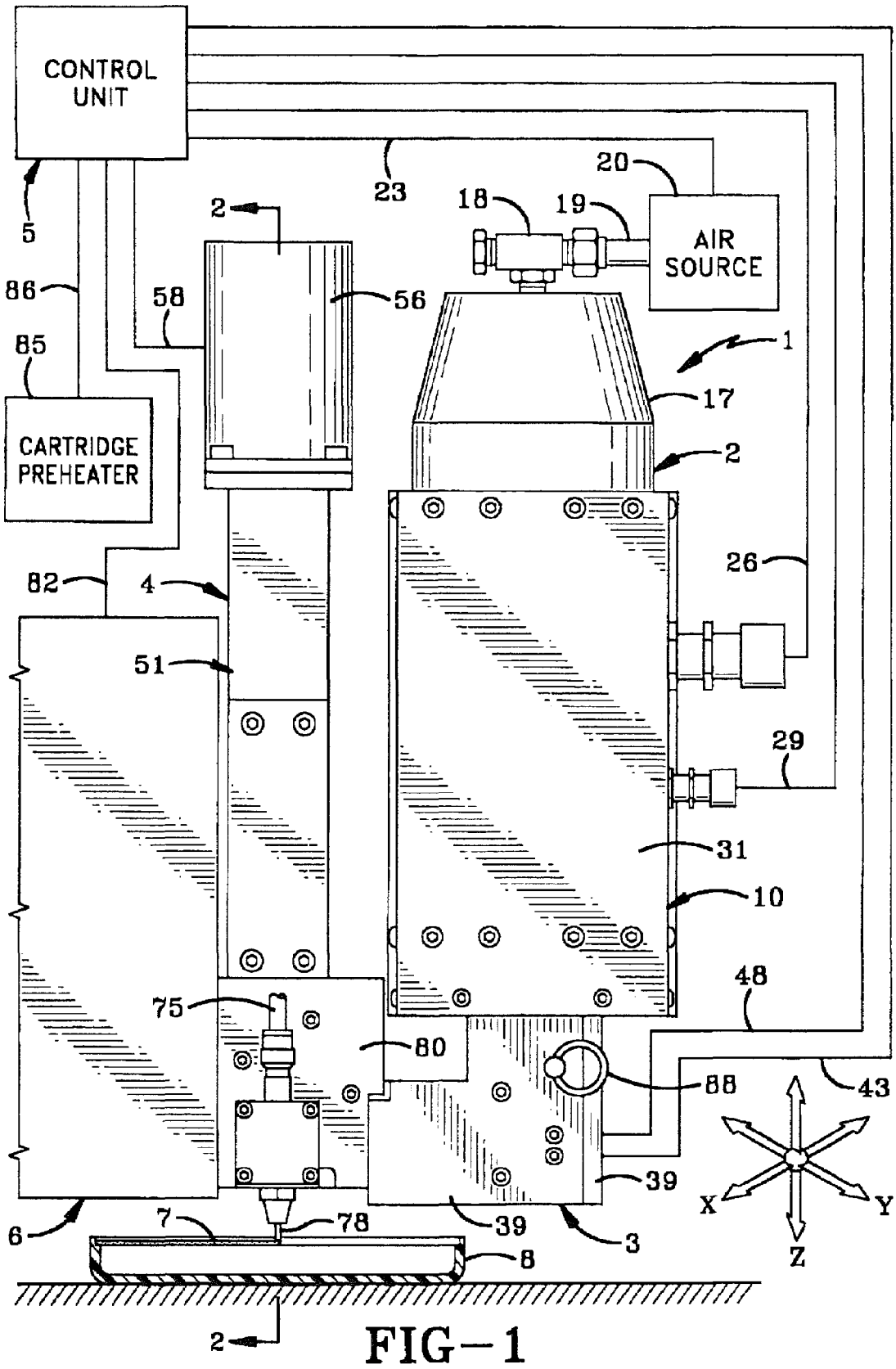
FIG. 1 is a diagrammatic side elevational view showing the apparatus of the present invention dispensing a precise quantity of the adhesive onto an object with the unit being mounted on a three-dimensional motion control device.
Figure 7:
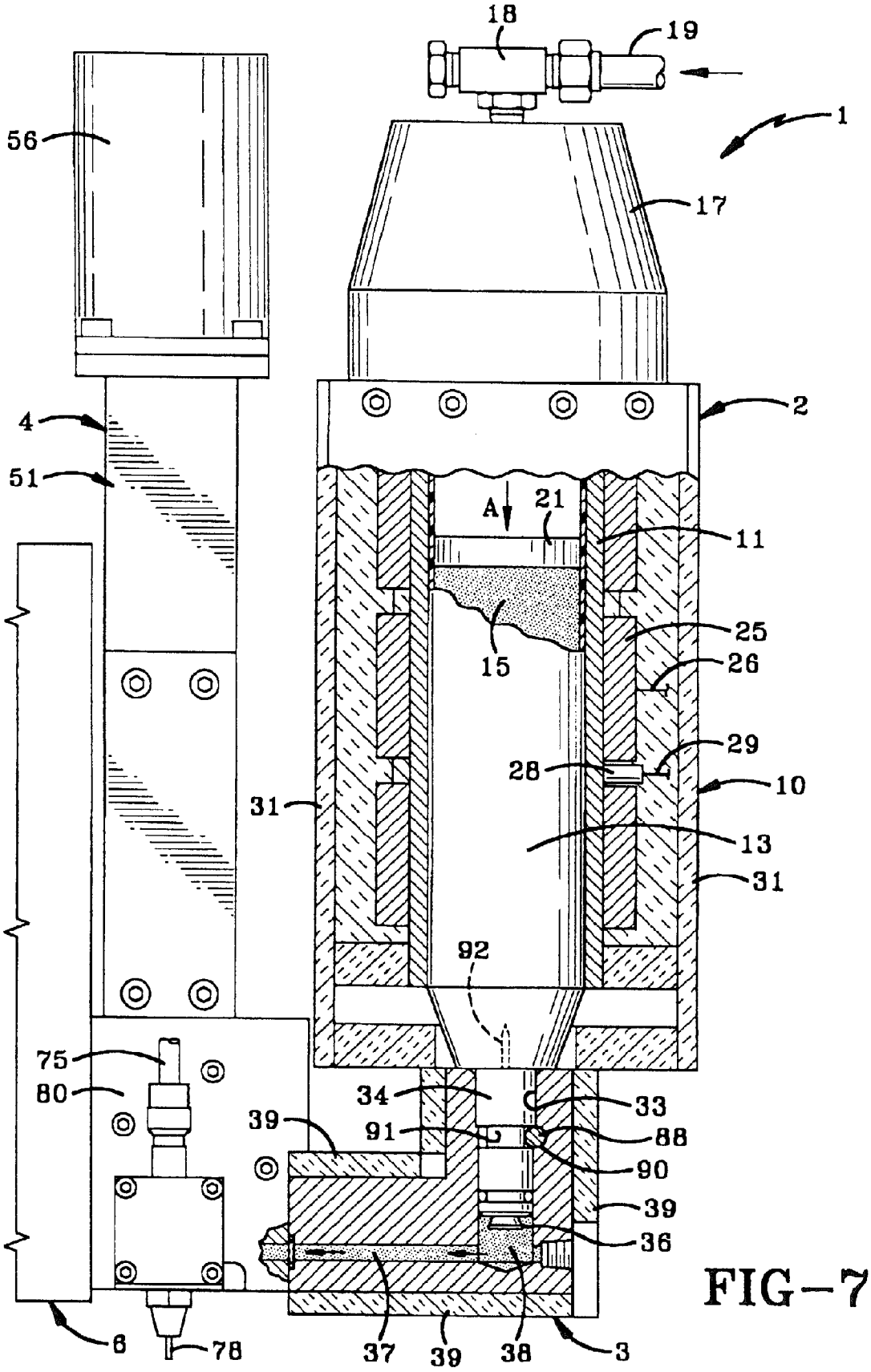
FIG. 7 is a side elevational view similar to FIG. 1 with the adhesive feed assembly and inlet block being shown in cross section.

The apparatus of the present invention which is in the form of a compact dispensing unit is indicated generally at 1, and is shown particularly in FIGS. 1 and 7. Unit 1 includes as its main components an adhesive feed assembly 2, an inlet block 3, a positive displacement adhesive dispenser 4, and a control unit 5. Unit 1 preferably is mounted on a programmable, two or three-dimensional motion control unit 6 for depositing a dot, bead, or a strip of an adhesive 7 precisely on an object 8.

Adhesive feed assembly 2 is best shown in FIG. 7 and includes a housing indicated generally at 10, which contains a hollow sleeve 11 adapted to slidably receive a cartridge 13 therein, containing a supply of a hot-melt adhesive 15. An end cap 17 is mounted on the top of housing 10 and has a coupling 18 for receiving an air supply line 19 for supplying a positive air pressure to a piston 21 located within the interior of cartridge 13 for moving in the direction of arrow A, for discharging adhesive 15 from the cartridge into and through inlet block 3. A remote pressurized air source 20 is connected to line 19 and is controlled by a conductor 23 connected to control unit 5.

In accordance with one of the features of the invention, one or more electric resistance heating elements 25 surround cartridge sleeve 11 for heating adhesive 15 contained therein to a predetermined level. Heating elements 25 are connected by one or more conductors 26 to control unit 5. A thermocouple 28 is in communication with sleeve 11 and is connected by a conductor 29 to control unit 5 for measuring the temperature of adhesive 15 to maintain it at a desired level. Housing 10 preferably is encased in insulation panels 31 to assist in retaining adhesive 15 at the desired temperature when heated by heating elements 25. Insulation 31 can be various types of insulation, one type of which is sold by General Electric Company under the trademark ULTEM.

In accordance with another feature of the invention, adhesive feed assembly 2 is connected directly to dispenser 4 by inlet block 3. Block 3 is L-shaped and includes a first or upper section formed with an inlet passage 33 (FIG. 7) in which is mounted a valve assembly 34 which receives the outlet end of cartridge 13. Valve assembly 34 extends throughout a portion of inlet passage 33 and terminates in a discharge outlet 36. An adhesive passage 37 extends through a second or lower section of block 3 and communicates with a lower end 38 of inlet passage 33 and extends generally at a right angle thereto. Thus, the material discharged from cartridge 13 passes through inlet block 3 and into dispenser 4. Inlet block 3 (FIGS. 3-6) preferably is formed of metal such as aluminum, and is covered with insulating panels 39, similar to panels 31 of housing 10 to reduce heat loss from the heated adhesive moving through the block.

A heater tube 40 (FIG. 6) is mounted within a passage 42 formed at least partially through the lower section of block 3 and is connected to control unit 5 by a conductor 43. A thermocouple 45 is mounted within a passage 47 formed at least partially through the lower section of block 3, adjacent and parallel with heater tube 40, and is connected to control unit 5 by a conductor 48. Alignment pins 49 and 50 (FIGS. 3 and 4) extend outwardly from the upper and lower sections of L-shaped block 3 for engagement within corresponding holes (not shown) formed in the bottom of housing 10 and dispenser 4 in order to properly align the adhesive passageways formed therein.

Figure 2:
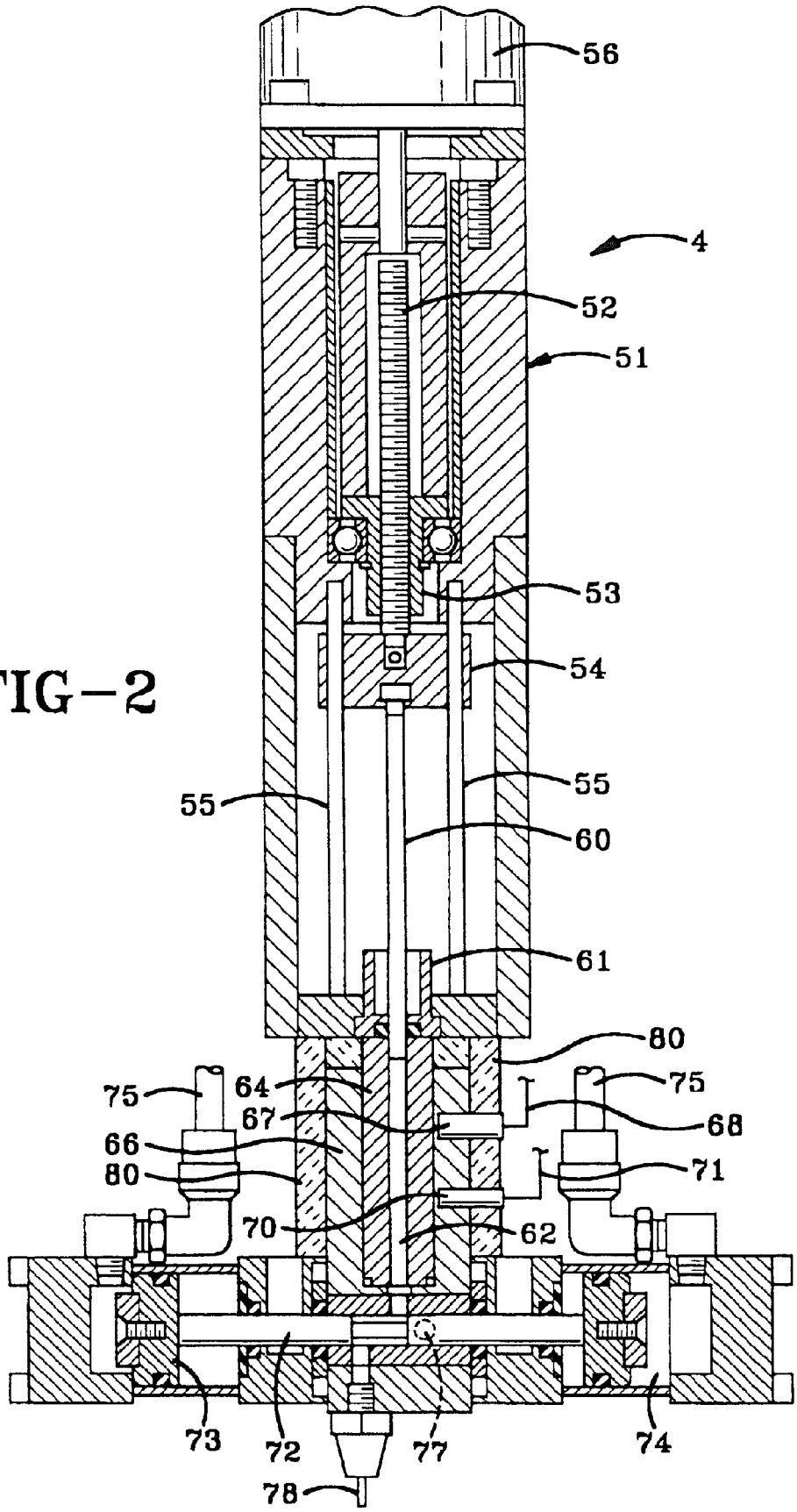
FIG. 2 is an enlarged fragmentary sectional view taken on line 2-2, FIG. 1.
Figure 3:
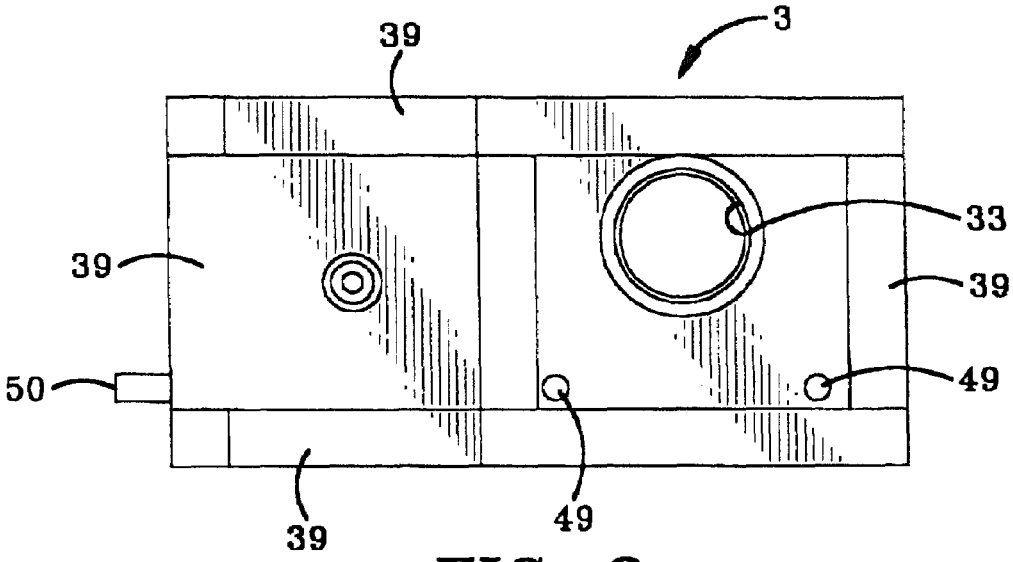
FIG. 3 is a top plan view of the inlet block.
Figure 4:
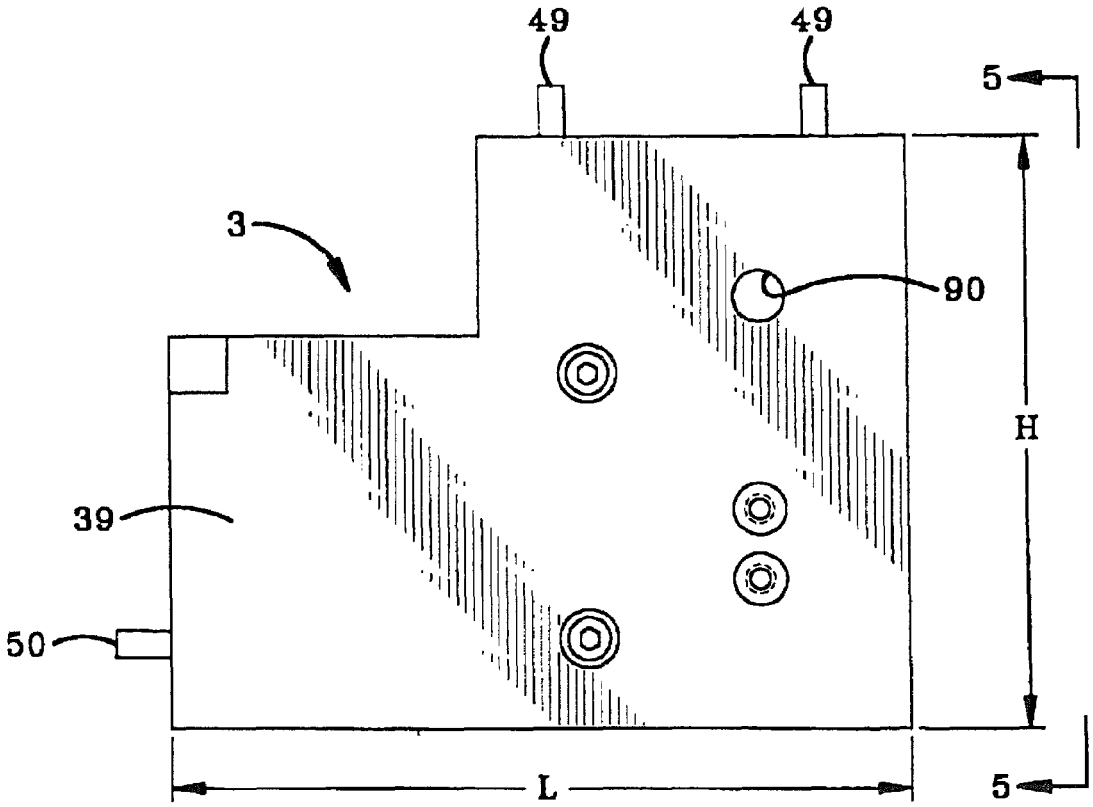
FIG. 4 is a side elevational view of the inlet block of FIG. 3.
Figure 8:
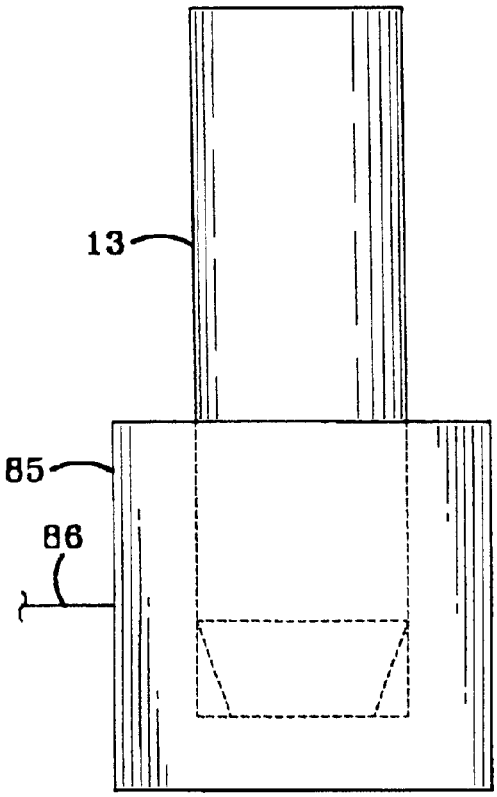
FIG. 8 is a diagrammatic view showing an adhesive cartridge in a preheater.
Figure 5:
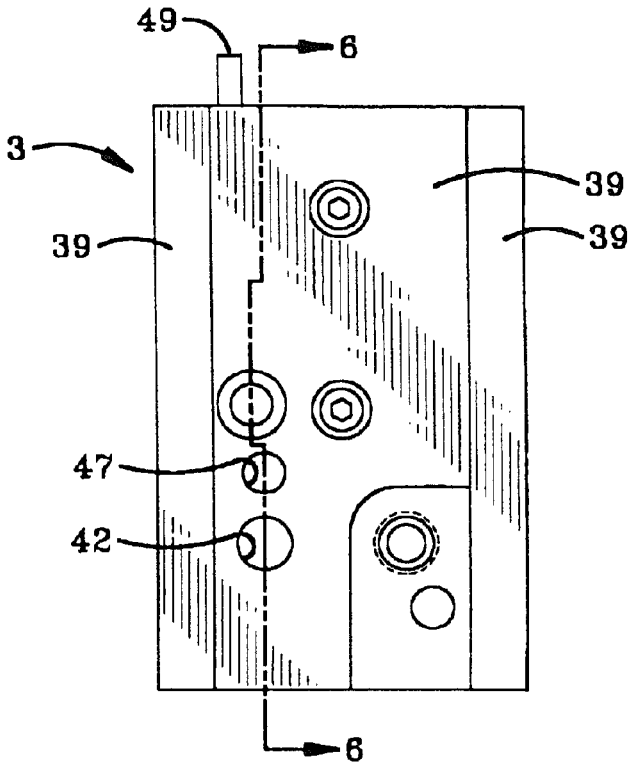
FIG. 5 is an end elevational view of the inlet block looking in the direction of arrows 5-5, FIG. 4.
Figure 6:
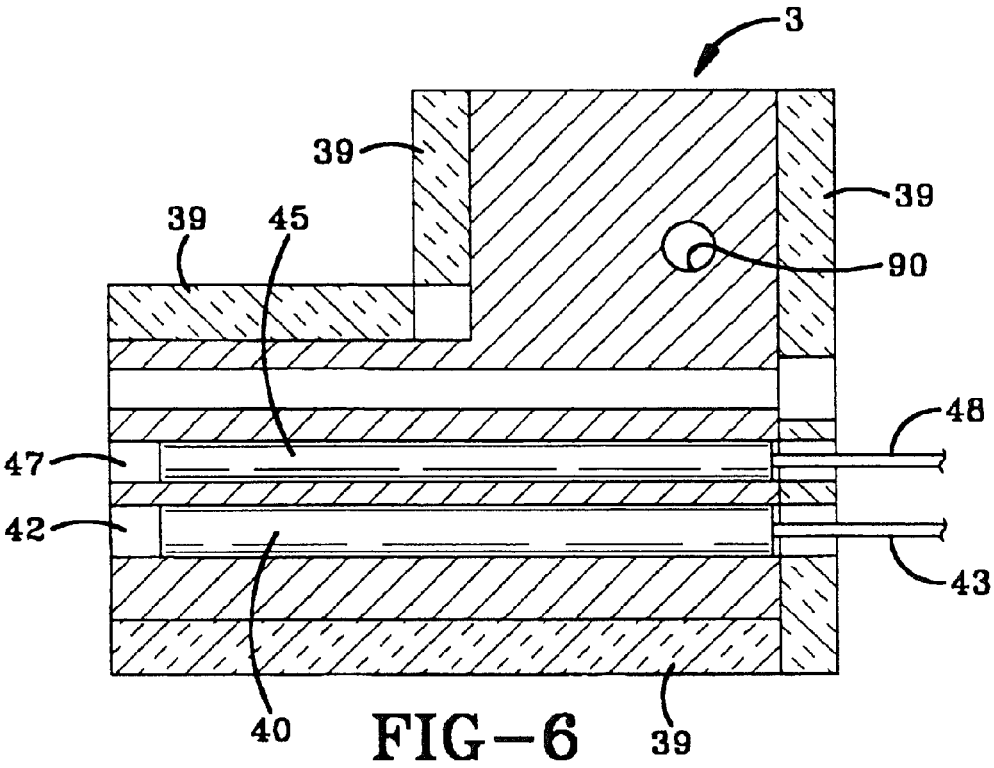
FIG. 6 is a sectional view taken on line 6-6, FIG. 5.

One type of positive displacement dispenser 4 for use in unit 1 can be of the type sold by Liquid Control Corporation of North Canton, Ohio as model number 1053 under the trademark DISPENSIT. It includes a main housing 51 (FIG. 2) containing a lead screw 52 which extends through a retaining ring 53. Screw 52 is connected to a metering rod connector 54 which moves along a pair of rods 55 when lead screw 52 is rotated by a motor 56 mounted on the top of housing 51. Motor 56 preferably is an electric motor and is connected to control unit 5 by one or more conductors 58. A dispensing rod 60 is connected to connector 54 and extends through a seal cup 61 into a metering channel 62. Channel 62 is formed in a sleeve 64 which is mounted within a block 66.

In accordance with the invention, a heating device, such as a heater tube 67 is connected with block 66 for maintaining metering channel 62, and in particular the adhesive contained therein, at a predetermined level. Heater tube 67 is connected to control unit 5 by a conductor 68. A thermocouple 70 is mounted in block 66 and is connected to control unit 5 by a conductor 71. Thus, this enables the temperature of the control block and correspondingly of the adhesive contained within metering channel 62, to be determined and accurately maintained by thermocouple 70 and heater tube 67.

Metering channel 62 communicates with a reciprocal metering spool 72 through an inlet opening 77 formed therein. Spool 72 is reciprocated between feed and discharge positions by a pair of pneumatic actuated pistons 73 located within cylinders 74, which are connected by air lines 75 to a source of compressed air, which in turn is connected to control unit 5. Spool 72 passes accurately metered measured amounts of adhesive for subsequent discharge through a discharge needle 78. The operation of dispenser 4 is similar to that described in U.S. Pat. Nos. 5,350,084 and 5,458,275, the contents of which are incorporated herein by reference, and thus is not described in further detail.

Block 66 is enclosed within insulating panels 80 to assist in maintaining the temperature of the adhesive within metering channel 62 and spool 72 at desired levels. Heater tube 67 and thermocouple 70 maintain and control the temperature of the adhesive within metering chamber 62, and correspondingly within measuring spool 72 and discharge needle 78 by the heat transferred from heated block 66.

In further accordance with the invention, unit 1 is mounted on a two or three-dimensional motion control system 6 which is connected to control unit 5 by one or more conductors 82. Motion control unit 6 can be one of various types of robotic-type devices well known in the manufacturing industry, and thus is not described in detail. Unit 6 receives control signals from unit 5 and will move unit 1 in the desired planes to accurately dispense adhesive strip 7 or dots along an object 8 in a repeatable, continuous fashion, such as on a manufacturing assembly line.

In accordance with another feature of the invention, a cartridge 13 is placed within a heating unit 85 which is connected to control unit 5 by a conductor 86. Heating unit 85 preferably will be located closely adjacent to, but not on, control unit 1. Unit 85 heats the adhesive to a desired temperature where it is maintained until the cartridge in feed assembly 2 is near empty or is close to the time limit of the heated adhesive. As soon as cartridge 13 within feed assembly 2 has reached a near empty stage or its time limit, a quick release pin 88 (FIGS. 1 and 7), which is mounted in a hole 90 formed in block 3 and passes through a channel 91 formed in valve assembly 34, is removed which enables the spent cartridge to be lifted out of valve assembly 34 and from sleeve 11 upon removal of end cap 17. Preheated cartridge 13 is then inserted into sleeve 11 with its discharge end being pierced by a needle 92 mounted in valve assembly 34 and end cap 17 reinstalled. The appropriate signal is then supplied to air source 20 through conductor 23 which forces piston 21 downwardly into the interior of cartridge 13 to move the adhesive out of discharge outlet 36 through discharge passage 37 of inlet block 3 and into dispenser 4 where it enters spool 72 through spool inlet 77. The adhesive flows through metering channel 62 for subsequent injection into metering spool 72 upon actuation of motor 56 and movement of dispenser rod 60, in order to accurately discharge the desired amount through discharge needle 78.

The temperature of the adhesive in a cartridge 13 is elevated to a certain level by preheating it in heating unit 85, and thus is ready to be dispensed when placed within feed assembly 2 instead of requiring a time lull while the adhesive is being heated to the required temperature. The preheated adhesive in newly placed cartridge 13, preferably is heated an additional 5° or 10° by heating elements 25 in sleeve 11, and then further heated several more degrees as it moves through inlet block 3 by heater tube 40. The temperature of the adhesive is either maintained, or preferably heated several more degrees by heater tube 67 in dispenser 4, so that it reaches the most efficient temperature just when being dispensed through needle valve 78. Thus, this series of heaters will maintain, and preferably raise the temperature of the adhesive as it moves through unit 1 from feed assembly 2 through inlet block 3 for subsequent discharge from dispenser 4 so that the preferred temperature is reached at the time of discharge through valve 78. The temperature is accurately maintained by the use of thermocouples 28, 45, and 70, which are connected to control unit 5. Thus, should the sensed temperature be too low or too high, an appropriate signal is sent to the respective heating elements or tubes 25, 40, and 67 for applying more or less heat to the adhesive, either within cartridge 13, or within the appropriate passages within inlet block 3 and dispenser 4.

Furthermore, the closeness of feed assembly 2 to dispenser 4 by mounting it directly thereto through heated inlet block 3 assists in maintaining this temperature control to a higher degree of accuracy than would be possible with an adhesive feed supply located remotely from the dispenser 4 as in prior art dispensers. For example, in the preferred embodiment inlet block 3 will have a length L (FIG. 4) of approximately 3.5 inches and a height H of approximately 2.6 inches. Thus, this enables the adhesive feed assembly to be mounted directly on dispenser 4 to enable the temperature to be maintained from the adhesive supply contained in a cartridge 13 before being dispensed through needle valve 78.

One type of adhesive used for many applications is a moisture-cured polyurethane which has a life of approximately 16 hours once it is heated to a certain level, afterwhich it begins to harden and loses the required viscosity. Thus, a cartridge 13 would be placed in preheater 85 and programmed to be heated to reach a desired temperature level at nearly the same time that the cartridge 13 contained in feed assembly 2 is exhausted. Thus, as soon as a cartridge is exhausted in feed assembly 2, it is removed and immediately replaced with a preheated cartridge whose temperature has been programmed to reach a desired level, thereby providing the maximum life to the adhesive. The adhesive is then progressively heated to a higher level as it moves through unit 1.

The control unit will be programmed so that an alarm will be actuated should the life of the adhesive within the cartridge of feed mechanism 2 be approached to insure that the cartridge is removed and replaced with another preheated cartridge to prevent damage to the equipment and/or an unsatisfactory adhesive being dispensed from dispenser 4. Control unit 5 also controls the actuation of piston 21, located within feed assembly 4, as well as the air to move piston 73 within dispenser 4. The control unit also can be programmed to communicate with motion control unit 6, as well as with motor 56 of dispenser 4.

Thus, in accordance with the invention, a very compact accurately controlled adhesive supply system and dispenser is provided which can be easily mounted on a motion control unit for dispensing very fine and accurately controlled beads or dots of an adhesive by a positive displacement dispenser, wherein the dispensing of the adhesive is accurately controlled by a central control unit which measures and maintains the temperature of the adhesive as it is being dispensed from a cartridge and through an inlet block and into the dispenser for subsequent dispensing therefrom.

It is understood that the adhesive is heated by the heaters applying heat to the cartridge or adjacent metal block or sleeve without physically contacting the adhesive. Likewise, the thermocouple can measure the temperature of the adjacent metal blocks, sleeves, cartridge, etc. to provide the temperature of the adhesive without directly contacting the adhesive.

If desired, adhesive feed assembly 3 can be mounted directly on dispenser 4 without the particular inlet block 3 shown and described above without affecting the concept of the invention. However, block 3 provides a convenient means of producing a support for the outlet end of cartridge 13 and transition between feed assembly 2 and dispenser 4.

It is understood that control unit 6 is a readily available and programmable computer of the type used in automated control systems, and can be adjusted by one skilled in the art for achieving the desired temperature, time of heating of the adhesive, speed and time of dispensing, etc.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of dispensing a time and temperature sensitive, moisture cured hot-melt adhesive from a cartridge containing said adhesive, said method comprising the steps of:

placing a cartridge containing the adhesive in a feed assembly;

heating the adhesive to a first temperature in the feed assembly;

moving the adhesive from the cartridge through a passage formed in an inlet block and into a positive displacement dispenser;

heating the adhesive moving through the inlet block to a second temperature;

heating the adhesive in the dispenser to a third temperature;

measuring and controlling the temperatures of the adhesive in the feed assembly, inlet block and dispenser; and dispensing the heated adhesive from a discharge needle of the dispenser onto an object by moving a positive displacement dispensing rod into a metering channel and toward the discharge needle for dispensing a predetermined amount of the adhesive from the dispenser.

2. The method defined in claim 1 including the step of progressively increasing the temperature of the adhesive as it moves through the feed assembly, inlet block, and dispenser.

3. The method defined in claim 1 including the step of heating the cartridge to a certain temperature prior to placing the cartridge in the feed assembly.

4. The method defined in claim 1 including the step of insulating the feed assembly, inlet block and positive displacement dispenser to reduce the escape of heat therefrom.

5. The method defined in claim 1 including the step of providing a quick disconnect in the inlet block to enable a spent adhesive cartridge to be rapidly removed and replaced with another cartridge.

6. The method defined in claim 1 including the step of mounting the feed assembly, inlet block and dispenser on a motion control system for accurately dispensing the heated adhesive onto the object.

7. The method defined in claim 6 including the step of the motion control system moving the feed assembly, inlet block and dispenser through three dimensions.

8. The method defined in claim 1 including the step of placing a thermocouple in each of the feed assembly, inlet block and dispenser for measuring the temperature of the adhesive contained therein.

9. The method defined in claim 1 including the step of placing a heater tube in each of the feed assembly, inlet block and dispenser for heating the adhesive therein.

10. A method of dispensing a time and temperature sensitive, moisture cured hot-melt adhesive from a cartridge containing said adhesive, said method comprising the steps of:

connecting together a positive displacement dispenser to an adhesive feed assembly by an intervening inlet block to form a single unit;

mounting the single unit on a motion control system;

placing a removable cartridge containing a fixed predetermined supply of the adhesive in the feed assembly;

moving the adhesive from the cartridge through a passage formed in the inlet block and into the positive displacement dispenser;

heating the adhesive moving through the inlet block to a predetermined temperature;

heating the adhesive in the dispenser to a temperature higher than the temperature in the inlet block;

measuring and controlling the temperatures of the adhesive in the inlet block and dispenser; and dispensing a predetermined amount of the heated adhesive from a discharge needle of the dispenser onto an object by moving a positive displacement dispensing rod into a metering channel and toward the discharge needle and controlling movement of the single unit in a selected axis by the motion control system for dispensing the heated adhesive onto the object.

11. The method defined in claim 10 including the step of heating the adhesive in the feed assembly.

12. The method defined in claim 10 including the step of heating the adhesive in the cartridge to a certain temperature prior to placing the cartridge in the feed assembly.

13. The method defined in claim 10 including the step of insulating certain of the feed assembly, inlet block and positive displacement dispenser to reduce the escape of heat therefrom.

14. The method defined in claim 10 including the step of providing a quick disconnect in the inlet block to enable a spent adhesive cartridge to be rapidly removed and replaced with another cartridge.

15. The method defined in claim 10 including the step of placing a thermocouple in each of the feed assembly, inlet block and dispenser for measuring the temperature of the adhesive contained therein.

16. The method defined in claim 10 including the step of placing a heater tube in each of the feed assembly, inlet block and dispenser for heating the adhesive therein.

* * * * *